US009268266B1

(12) United States Patent
Wu et al.

(10) Patent No.: US 9,268,266 B1
(45) Date of Patent: Feb. 23, 2016

(54) TRANSFER ASSIST BLADE

(71) Applicant: Xerox Corporation, Norwalk, CT (US)

(72) Inventors: Jin Wu, Pittsford, NY (US); Jonathan H. Herko, Walworth, NY (US); Amy C. Porter, Pittsford, NY (US); Lin Ma, Pittsford, NY (US)

(73) Assignee: Xerox Corporation, Norwalk, CT (US)

( * ) Notice: Subject to any disclaimer, the term of this patent is extended or adjusted under 35 U.S.C. 154(b) by 0 days.

(21) Appl. No.: 14/722,710

(22) Filed: May 27, 2015

(51) Int. Cl.
*G03G 15/16* (2006.01)

(52) U.S. Cl.
CPC ..... *G03G 15/1675* (2013.01)

(58) Field of Classification Search
CPC ..... G03G 15/1675
USPC ..... 399/297, 303, 313, 316, 317
See application file for complete search history.

(56) References Cited

U.S. PATENT DOCUMENTS

| | | | | |
|---|---|---|---|---|
| 2,836,725 | A | 5/1958 | Vyverberg | |
| 4,341,456 | A | 7/1982 | Iyer et al. | |
| 5,568,238 | A | 10/1996 | Osbourne et al. | |
| 5,893,665 | A | 4/1999 | Ichikawa et al. | |
| 6,496,673 | B2 | 12/2002 | Bessho | |
| 6,606,478 | B2 * | 8/2003 | Fayette et al. | 399/316 |
| 7,386,263 | B2 * | 6/2008 | Stahuber | 399/313 |
| 8,594,553 | B2 | 11/2013 | Uematsu et al. | |
| 2002/0044800 | A1 | 4/2002 | Kimura | |
| 2011/0150514 | A1 | 6/2011 | Falvo et al. | |
| 2011/0249997 | A1 | 10/2011 | Robles-Flores | |
| 2013/0028642 | A1 | 1/2013 | Yagi et al. | |

OTHER PUBLICATIONS

Office Action for U.S. Appl. No. 14/016,502, dated Oct. 7, 2014, 17 pages.
Notice of Allowance and Fee(s) Due for U.S. Appl. No. 14/016,502, dated Feb. 5, 2015, 10 pages.

* cited by examiner

*Primary Examiner* — Hoang Ngo
(74) *Attorney, Agent, or Firm* — Hoffman Warnick LLC

(57) ABSTRACT

Described is a transfer assist blade for an electrostatographic machine. The electrostatographic machine includes a charging station for charging a copy sheet to attract a developed image from an image bearing surface to a copy sheet wherein said charging station includes a corona generating device. The transfer assist blade includes a wear layer having a surface resistance of greater than about $10^{10}$ ohms. The transfer assist blade includes an interior layer having a thickness of from about 150 microns to about 500 microns. The transfer assist blade includes a back layer including a polyethylene terephthalate film having an outer layer including cross-linked aziridine/carboxylated polyester at a weight ratio of from about 0.5/99.5 to about 40/60 and a conductive component, wherein an outer surface of the back layer has a surface resistance of from about $1\times10^{8}$ ohms to about $9.99\times10^{8}$ ohms.

20 Claims, 2 Drawing Sheets

TRANSFER ASSIST BLADE

BACKGROUND

1. Field of Use

This disclosure is generally directed an apparatus for assisting transfer of a developed image to a copy substrate in an electrostatographic printing machine. The apparatus enhances physical contact between the copy substrate and the developed image, wherein the apparatus includes a conductive blade member for eliminating image defects.

2. Background

Generally, the process of electrostatographic copying is initiated by exposing a light image of an original document onto a substantially uniformly charged photoreceptive member. Exposing the light image onto the charged photoreceptive member discharges a photoconductive surface thereof in areas corresponding to non-image areas in the original document while maintaining the charge in image areas, thereby creating an electrostatic latent image of the original document on the photoreceptive member. Thereafter, developing material comprising charged toner particles is deposited onto the photoreceptive member such that the toner particles are attracted to the charged image areas on the photoconductive surface to develop the electrostatic latent image into a visible image. This developed image is transferred from the photoreceptive member, either directly or after an intermediate transfer step, to an image support substrate such as a copy sheet, creating an image thereon corresponding to the original document. The transferred image is typically affixed to the image support substrate to form a permanent image thereon through a process called "fusing". In a final step, the photoconductive surface of the photoreceptive member is cleaned to remove any residual toner particles thereon in preparation for successive imaging cycles.

The electrostatographic copying process described above is well known and is commonly used for light lens copying of an original document. Analogous processes also exist in other electrostatographic printing applications such as, for example, digital printing where the latent image is produced by a modulated laser beam, or ionographic printing and reproduction, where charge is deposited on a charge retentive surface in response to electronically generated or stored images.

The process of transferring charged toner particles from an image bearing member, such as the photoreceptive member, to an image support substrate, such as the copy sheet is accomplished at a transfer station, wherein the transfer process is enabled by electrostatically overcoming adhesive forces holding the toner particles to the image bearing member. In a conventional electrostatographic machine, transfer is achieved by transporting the image support substrate into the area of the transfer station where electrostatic force fields sufficient to overcome the forces holding the toner particles to the photoconductive surface are applied to attract and transfer the toner particles over onto the image support substrate. In general, such electrostatic force fields are generated via electrostatic induction using a corona generating device, wherein the copy sheet is placed in direct contact with the developed toner image on the photoconductive surface while the reverse side of the copy sheet is exposed to a corona discharge. This corona discharge generates ions having a polarity opposite that of the toner particles, thereby electrostatically attracting and transferring the toner particles from the photoreceptive member to the image support substrate. An exemplary scorotron ion emission transfer system is disclosed in U.S. Pat. No. 2,836,725.

During electrostatic transfer of a toner image to a copy sheet, it is generally necessary, or at least desirable, for the copy sheet to be in uniform intimate contact with the photoconductive surface and the toner powder image developed thereon. Unfortunately, however, the interface between the photoreceptive surface and the copy substrate is not always optimal. In particular, non-flat or uneven image support substrates, such as copy sheets that have been mishandled, left exposed to the environment or previously passed through a fixing operation (e.g., heat and/or pressure fusing) tend to promulgate imperfect contact with the photoreceptive surface of the photoconductor. Further, in the event the copy sheet is wrinkled, the sheet will not be in intimate contact with the photoconductive surface and spaces or air gaps will materialize between the developed image on the photoconductive surface and the copy sheet where there is a tendency for toner not to transfer across these gaps, causing variable transfer efficiency and, in extreme cases, creating areas of low or no transfer, resulting in a phenomenon known as image transfer deletion. Clearly, an image transfer deletion is very undesirable in that useful information and indicia are not reproduced on the copy sheet.

As described, the typical process of transferring development materials in an electrostatographic system involves the physical detachment and transfer of charged toner particles from an image bearing photoreceptive surface onto an image support substrate via electrostatic force fields. Thus, a very critical aspect of the transfer process is focused on the application and maintenance of high intensity electrostatic fields in the transfer region for overcoming the adhesive forces acting on the toner particles as they rest on the photoreceptive member. Another critical aspect of the transfer process is focused on the application of mechanical force on the copy sheet in the transfer region for overcoming the adhesive forces acting on the toner particles as they rest on the photoreceptive member.

It would be desirable to provide a transfer assist device that meets the mechanical and electrical needs for transferring toner particles from the photoreceptive member to the copy sheet.

SUMMARY

Disclosed herein is an apparatus for transferring a developed image from an image bearing surface to a copy sheet. The apparatus includes a charging station for charging the copy sheet to attract the developed image from the image bearing surface to the copy sheet. The charging station includes a corona generating device spaced from the image bearing surface to define a gap therebetween through which the copy sheet passes. The apparatus includes a transfer assist blade for pressing the copy sheet into contact with the developed image on the image bearing surface in a region proximate to the charging station. The transfer assist blade is shifted between a non-operative position spaced from the image bearing surface, and an operative position in contact with the copy sheet on the image bearing surface. The transfer assist blade includes in sequence a wear layer for contacting the copy sheet; an interior layer and a back layer including a polyethylene terephthalate film having an outer layer including cross-linked aziridine/carboxylated polyester and a conductive component wherein an outer surface of the back layer has a surface resistance of from about $1\times10^8$ ohms to about $9.99\times10^8$ ohms. The apparatus includes a lever member for shifting the transfer assist blade between the non-operative position and the operative positions responsive to a registration signal.

There is described a transfer assist blade for an electrostatographic machine. The electrostatographic machine includes a charging station for charging a copy sheet to attract a developed image from an image bearing surface to a copy sheet wherein said charging station includes a corona generating device spaced from the image bearing surface to define a gap therebetween through which the copy sheet passes. The transfer assist blade includes a wear layer for contacting a copy sheet, wherein the wear layer of the transfer assist blade has a surface resistance of greater than about $10^{10}$ ohms. The transfer assist blade includes an interior layer having a thickness of from about 150 microns to about 500 microns. The transfer assist blade includes a back layer including a polyethylene terephthalate film having an outer layer comprising cross-linked aziridine/carboxylated polyester at a weight ratio of from about 0.5/99.5 to about 20/80 and a conductive component, wherein an outer surface of the back layer has a surface resistance of from about $1\times10^8$ ohms to about $9.99\times10^8$ ohms.

Disclosed herein is an electrostatographic printing machine of the type in which a developed image is transferred from a photoconductive surface to a copy sheet at a transfer station, The printing machine includes an electrostatic charging unit for charging the copy sheet to attract the developed image from the photoconductive surface toward the copy sheet. The electrostatic charging unit includes a corona generating device spaced from the photoconductive surface to define a gap therebetween through which the copy sheet passes. The printing machine includes a transfer assist blade for pressing the copy sheet into contact with at least the developed image on the photoconductive surface. The transfer assist blade includes a wear layer for contacting the copy sheet, wherein the wear layer of the transfer assist blade has a surface resistance of greater than about $10^{10}$ ohms The transfer assist blade has an interior layer having a thickness of from about 150 microns to about 500 microns. The transfer assist blade includes a back layer comprising a polyethylene terephthalate film having an outer layer comprising cross-linked aziridine/carboxylated polyester at a weight ratio of from about 0.5/99.5 to about 40/60, a conductive component, a leveling agent and an acid catalyst. The outer surface of the back layer has a surface resistance of from about $1\times10^8$ ohms to about $9.99\times10^8$ ohms. The transfer assist blade adapted to be shifted between a non-operative position spaced from the photoconductive surface, and an operative position in contact with the copy sheet on the photoconductive surface. The printing machine includes and a lever member for shifting the transfer assist blade between the non-operative position and the operative positions, the lever member responsive to a registration signal.

BRIEF DESCRIPTION OF THE DRAWINGS

The accompanying drawings, which are incorporated in and constitute a part of this specification, illustrate several embodiments of the present teachings and together with the description, serve to explain the principles of the present teachings.

It should be noted that some details of the figures have been simplified and are drawn to facilitate understanding of the embodiments rather than to maintain strict structural accuracy, detail, and scale.

DESCRIPTION OF THE EMBODIMENTS

Reference will now be made in detail to embodiments of the present teachings, examples of which are illustrated in the accompanying drawings. Wherever possible, the same reference numbers will be used throughout the drawings to refer to the same or like parts.

In the following description, reference is made to the accompanying drawings that form a part thereof, and in which is shown by way of illustration specific exemplary embodiments in which the present teachings may be practiced. These embodiments are described in sufficient detail to enable those skilled in the art to practice the present teachings and it is to be understood that other embodiments may be utilized and that changes may be made without departing from the scope of the present teachings. The following description is, therefore, merely illustrative.

Illustrations with respect to one or more implementations, alterations and/or modifications can be made to the illustrated examples without departing from the spirit and scope of the appended claims. In addition, while a particular feature may have been disclosed with respect to only one of several implementations, such feature may be combined with one or more other features of the other implementations as may be desired and advantageous for any given or particular function. Furthermore, to the extent that the terms "including", "includes", "having", "has", "with", or variants thereof are used in either the detailed description and the claims, such terms are intended to be inclusive in a manner similar to the term "comprising." The term "at least one of" is used to mean one or more of the listed items can be selected.

Notwithstanding that the numerical ranges and parameters setting forth the broad scope of embodiments are approximations, the numerical values set forth in the specific examples are reported as precisely as possible. Any numerical value, however, inherently contains certain errors necessarily resulting from the standard deviation found in their respective testing measurements. Moreover, all ranges disclosed herein are to be understood to encompass any and all sub-ranges subsumed therein. For example, a range of "less than 10" can include any and all sub-ranges between (and including) the minimum value of zero and the maximum value of 10, that is, any and all sub-ranges having a minimum value of equal to or greater than zero and a maximum value of equal to or less than 10, e.g., 1 to 5. In certain cases, the numerical values as stated for the parameter can take on negative values. In this case, the example value of range stated as "less than 10" can assume negative values, e.g. −1, −2, −3, −10, −20, −30, etc.

Figure 1:
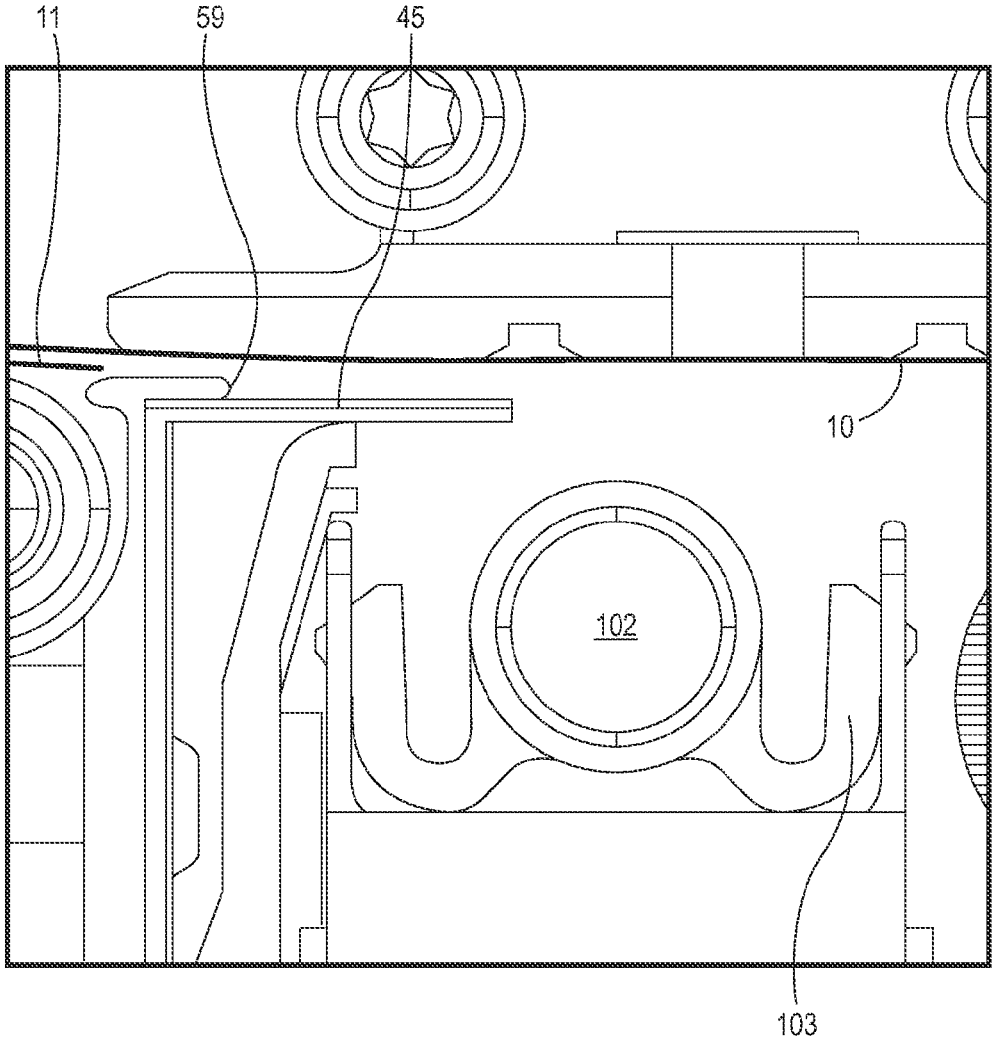
FIG. 1 is sectional side view showing a transfer assist blade disclosed herein and its use in an electrostatographic printing machine to press a copy sheet against a developed image on a photoconductive surface.

With specific reference to FIG. 1, the transfer assist apparatus is depicted in a sectional view to more clearly reveal the various components included therein. As shown in FIG. 1, a copy substrate 11, (also referred to as a copy sheet or a print substrate) is fed toward photoconductive belt 10. A charging station includes a corona generating device 102, which can include a generally U-shaped shield, indicated generally by the reference numeral 103. The corona generating device 102 charges the copy sheet 11 at the transfer station to attract the toner powder image from the photoconductive belt 10 to the copy sheet 11. The corona generating device 102 is spaced from the image bearing surface of the photoconductive belt 10 to define a gap therebetween through which the copy sheet passes. One skilled in the art will appreciate that any suitable corona generating device may be employed, as for example, a corona generator having an electrode which is comprised of spaced pins or a wire and a shield which may be limited to a pair of side walls having no back wall.

The transfer assist blade 45 presses the copy sheet into intimate contact with the toner powder image on photoconductive belt 10. The transfer assist blade 45 continuously exerts a force toward photoconductive belt 10 when in an operative position. This force is opposed by the end of lever arm 59 for holding the blade 45 away from the surface of the photoreceptor 10.

A lever arm 59 or lever member is mounted adjacent to transfer assist blade 45, having a free end which contacts blade 45 along the protruding segment thereof. In an embodiment, the opposite end of lever arm 59 is secured via pivot arm to a solenoid (not shown). Lever arm 59 is adapted to be pivoted about a pivot point along a central portion where actuation of the solenoid pivots the lever arm 59 permitting blade the transfer assist blade 45 to flex or pivot toward the surface of the photoreceptor 10 and into an operative position against the back of the copy sheet 11. Conversely, when the solenoid is de-energized or de-actuated, the transfer assist blade 45 is be deflected away from the surface of the photoreceptor 10, to a non-operative position. It will further be appreciated that the transfer assist blade 45 described herein may be advantageously shifted between the operative and non-operative positions by some mechanism other than a solenoid, such as a stepper motor, a rotary solenoid, etc.

As transfer assist blade 45 moves from the non-operative position to the operative position, the free end of blade 45 contacts the back of the copy sheet 11 and presses the copy sheet 11 against the developed toner powder image on photoconductive belt 10. This substantially eliminates any spaces between the copy sheet and the toner powder image, thereby enhancing the transfer of the toner powder image to the copy sheet 11 such that the toner powder image transferred to the copy sheet is substantially deletion free. After transfer is completed, a light sensor (not shown) detects the trailing edge of the copy sheet 11, and, after a suitable delay, the controller transmits a de-energizing signal to the solenoid and moving transfer assist blade 45 it from the operative position to the non-operative position, away from the surface of the photoreceptor 10. Thus, as the copy sheet 11 passes out of the transfer station so that the transfer assist blade 45 does not come in direct contact with the photoconductive surface.

The precise timing of the entrance of a copy sheet 11 is determined by a registration synchronization signal, which is processed by a circuit for controlling the actuation of transfer assist blade 45. Transfer assist blade 45 is moved from a non-operative position, spaced from the copy sheet and the photoconductive belt 10 to an operative position in contact with the back side of the copy sheet. A mechanical transport mechanism such as a solenoid, described previously, moves transfer assist blade 45 between the operative and non-operative positions. In the operative position, blade 45 presses the copy sheet into contact with the toner powder image developed on photoconductive belt 10 for substantially eliminating any spaces between the copy sheet and the toner powder image such that the continuous pressing of the sheet into contact with the toner powder image at the transfer station insures that the copy sheet is in substantially intimate contact with the belt 10. As the trailing edge of the copy sheet passes a light sensor (not shown), the light sensor transmits a registration synchronization signal to a processing circuit which de-energizes the solenoid for shifting the blade 45 to its non-operative position. In the non-operative position, blade 45 is spaced from the copy sheet and the photoconductive belt, insuring that blade 45 does not scratch the photoconductive belt or accumulate toner particles thereon which may be deposited on the backside of the next successive copy sheet. An illustrative type of light sensor and delay circuit is described in U.S. Pat. No. 4,341,456, which is hereby incorporated by reference in its entirety.

The transfer assist blade (TAB) achieves the proper electrostatic field and pressure on the copy sheet by a backing film including a partially conductive layer on polyethylene terephthalate (PET) sheet, where the conductive layer is exposed to corona or electrical field, which needs meeting a narrow resistance specification.

Figure 2:
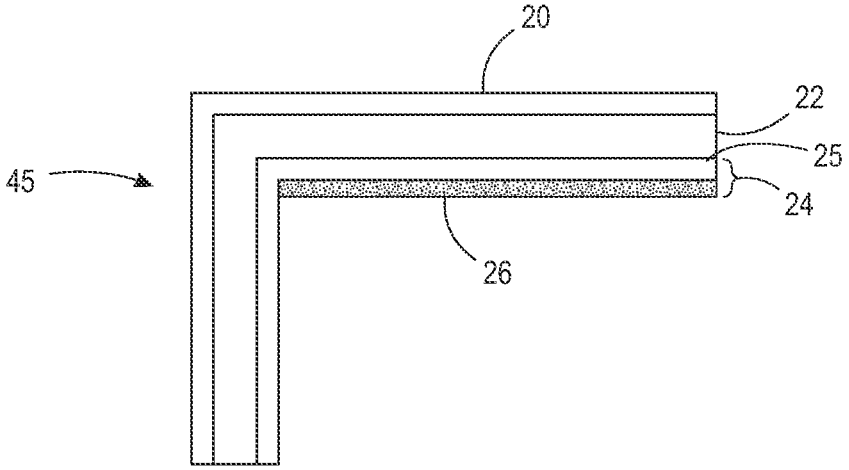
FIG. 2 is a sectional view of the transfer assist blade described herein.

Turning now to FIG. 2, a transfer assist blade 45, according to various embodiments is shown in greater detail. The transfer assist blade 45 is able to deflect as it urges the copy sheet into contact with the photoconductor. The transfer assist blade 45 deflects about 3 mm under a 3 gram load. The measurement is done in a cantilever-like setup, where the transfer assist blade sample is placed on an edge, loaded at the tip with a force gauge, and deflection is measured on a scale in the back. The total thickness of the transfer assist blade is from about 350 microns to about 900 microns. The transfer assist blade 45 includes a wear layer 20 which contacts the copy sheet 11 during operation. The wear layer 20 has a thickness of from about 100 microns to about 200 microns or in embodiments from about 110 microns to about 190 microns or from about 120 microns to about 180 microns. The wear layer 20 is composed of an ultra high molecular weight polymer such as 5425 UHMW polyethylene film with acrylic based pressure sensitive adhesive on one side, available from 3M. The wear layer 20 is insulating and has a surface resistance greater than about $10^{10}$ ohms.

The transfer assist blade 45 includes one or more interior layers composed of polyester, such as Mylar®. The total thickness of interior layer(s) 22 is from about 150 microns to about 500 microns or in some embodiments from about 180 microns to about 450 microns or from about 200 microns to about 400 microns. In embodiments, 1 to 5 layers of material are used for the interior layer 22.

The transfer assist blade 45 includes a back layer 24. The back layer 24 has a thickness of from about 50.5 microns to about 250 microns, or in embodiments from about 75.5 microns to about 220 microns or from about 80.5 microns to about 215 microns. The back layer 24 is requires a surface resistance (the surface facing the corona) of between about $1\times10^8$ ohms to about $9.99\times10^8$ ohms. The range of surface resistance is required to allow adhesion between the interior layer and the back layer and to prevent contamination from dirt or toner particles. Without the back layer having the required resistance, dirt accumulates and transfers to the copy substrate causing undesired print artifacts. Also, the surface resistance of the back layer is required to tailor the corona field at the very tip of the blade and prevent high voltage breakdown which can cause undesired print artifacts.

The wear layer 20, interior layer 22 and the back layer 24 are bonded together with an adhesive.

The back layer 24 is made from a polyethylene terephthalate (PET) film 25 having an outer layer 26 of cross-linked aziridine/carboxylated polyester and a conductive component. The conductive component provides conductivity to the outer layer 26 and allows the surface resistance to meet the $1\times10^8$ ohms to about $9.99\times10^8$ ohms requirement. The PET film 25 has a thickness of from about 50 microns to about 200 microns, or in embodiments from about 75 microns to about 190 microns or from about 80 microns to about 180 microns. The outer layer 26 of the back layer 24 includes the cross-linked aziridine/carboxylated polyester and a conductive component has a thickness of from about 0.5 microns to about 50 microns, or from about 5 to about 30 microns, or form about 8 to 25 microns.

The cross-linked aziridine/carboxylated polyester in the outer layer 26 is present in a weight ratio of from about 0.5/99.5 to about 40/60, or from about 1/99 to about 30/70. Examples of the disclosed aziridine cross-linkers include an ethylene imine based tri-functional polyaziridine (PZ-33 from PolyAziridine, LLC., Medford, N.J.; aziridine content=6.4-7.3 meq/g, aziridine functionality=3.3) as shown below (Structure 1), an propylene imine tri-functional polyaziridine (PZ-28 from PolyAziridine, LLC., Medford, N.J.; aziridine content=5.4-6.6 meq/g, aziridine functionality=2.8) as shown below (Structure 2) or a tri-functional polyaziridine (Crosslinker® CX-100 from DSM NeoResins Inc., Wilmington, Mass.).

Structure 1

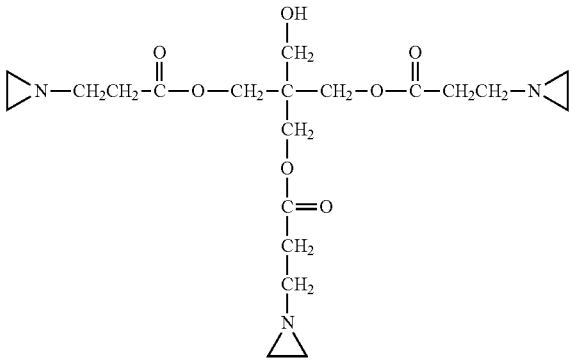

Structure 2

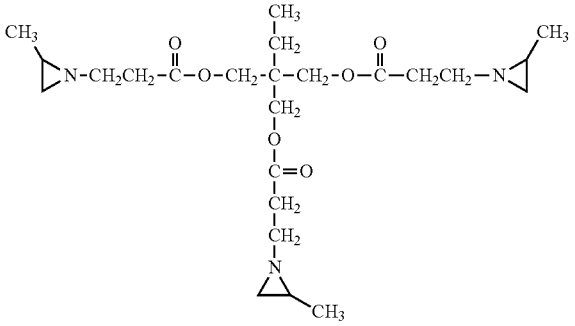

Examples of the disclosed carboxylated polyesters include URALAC® from DSM Coating Resins, Augusta, Ga.; KINTE® Polyester from China; and ALYMERS® from INOPOL Co. Ltd., South Korea. Specific example include ALYMERS® HC-7002 (acid value=27-35, $T_g$=58° C.); HC-7801 (acid value=28-38, $T_g$=62° C., $M_w$=6,900, $M_n$=2,400), which is a mol % of trimellitic acid; URALAC® P3250 (acid value=70-85, $T_g$=55° C.), which is a polymerization product of 7 mole percent of diethylene glycol, 42 mole percent of neopentyl glycol, 43 mole percent of terephthalic acid, 5 mole percent of isophthalic acid and 2 mole percent of adipic acid.

The back layer 24 shows much improved rub resistance over a thermoplastic polyester back film. The overcoat coating dispersion of polyaziridine and carboxylated polyester and a conductive component is coated on the extruded PET film 25. The dispersion includes a solvent, such as methylene chloride. In an embodiment, (ALYMERS® HC-7002/Crosslinker® CX-100/EMPEROR® E1200/NACURE® XP-357/BYK® 333=75/25/6.5/0.2/0.05 in methylene chloride at about 20 weight percent solids) can be extrusion coated on PET film, and subsequently cured at 140° C. for 5 minutes.

The back layer 24 is extruded and coated with the outer layer 26. The outer layer 26 is coated from a dispersion and dried or cured in 3-5 minutes. The manufacturing process of the back layer is commercially viable. The fast curing crosslinking system of aziridine/carboxylated polyester has a drying (curing) time to of 5 minutes or less.

Besides the primary components of the two resins (polyaziridine and carboxylated polyester), the outer layer 26 includes a conductive component. The conductive component in the outer layer 26 is selected from the group consisting of: carbon black, carbon nanotubes, graphene, graphite, metal oxides, polyaniline, polypyrrole and polythiophene. The outer layer 26 requires a surface resistance (the surface facing the corona) of between about $1\times10^8$ ohms to about $9.99\times10^8$ ohms. Thus, the amount of conductive component in the outer layer is adjusted to meet this requirement.

The outer layer 26 can also include a leveling agent. The leveling agent is selected is selected the group consisting of a polyester modified polydimethylsiloxane, a polyether modified polydimethylsiloxane, a polyacrylate modified polydimethylsiloxane, a polyester polyether modified polydimethylsiloxane, and mixtures thereof. Examples include a polyether modified polydimethylsiloxane, commercially available from BYK Chemical with the trade name of BYK® 333, BYK® 330 (about 51 weight percent in methoxypropylacetate) and 344 (about 52.3 weight percent in xylene/isobutanol=80/20), BYK®-SILCLEAN 3710 and 3720 (about 25 weight percent in methoxypropanol); a polyester modified polydimethylsiloxane, commercially available from BYK Chemical with the trade name of BYK® 310 (about 25 weight percent in xylene) and 370 (about 25 weight percent in xylene/alkylbenzenes/cyclohexanone/monophenylglycol=75/11/7/7); a polyacrylate modified polydimethylsiloxane, commercially available from BYK Chemical with the trade name of BYK®-SILCLEAN 3700 (about 25 weight percent in methoxypropylacetate); or a polyester polyether modified polydimethylsiloxane, commercially available from BYK Chemical with the trade name of BYK® 375 (about 25 weight percent in Di-propylene glycol monomethyl ether). The amount of leveling agent in the outer layer is from about 0.1 weight percent to about 5 weight percent, or from about 0.3 weight percent to about 4 weight percent, or from about 0.5 weight percent to about 2.0 weight percent.

The outer layer of the back layer can include acid catalyst. The acid catalyst is selected from the group consisting of: aliphatic carboxylic acids, such as acetic acid, chloroacetic acid, trichloroacetic acid, trifluoroacetic acid, oxalic acid, maleic acid, malonic acid, lactic acid and citric acid; aromatic carboxylic acids, such as benzoic acid, phthalic acid, terephthalic acid and trimellitic acid; aliphatic and aromatic sulfonic acids, such as methanesulfonic acid, dodecylsulfonic acid, benzenesulfonic acid, dodecylbenzenesulfonic acid, naphthalenesulfonic acid, p-toluenesulfonic acid, dinonylnaphthalenesulfonic acid (DNNSA), dinonylnaphthalenedisulfonic acid (DNNDSA) and phenolsulfonic acid; and phosphoric acid and mixtures thereof. The amount of acid catalyst in the outer layer of the back layer is from about 0.1 to about 5 weight percent, or from about 0.5 to about 3 weight percent]

Specific embodiments will now be described in detail. These examples are intended to be illustrative, and not limited to the materials, conditions, or process parameters set forth in these embodiments. All parts are percentages by solid weight unless otherwise indicated.

EXAMPLES

Experimentally, an overcoat dispersion was prepared as follows: a carboxylated polyester (ALYMERS® HC-7002 from INOPOL) was mixed with a polyaziridine (Crosslinker® CX-100 from DSM NeoResins), an acid catalyst (NACURE® XP-357 from King Industries) and a polyether modified polydimethylsiloxane (BYK® 333 from BYK Chemical) in a weight ratio of about 75/25/0.2/0.05 in methylene chloride (about 20 weight percent solids) via agitation to obtain a clear polymeric base solution. Carbon black (EMPEROR® E1200 from CABOT) was added to the above mixture and mixed with a ball mill having 2 mm stainless steel shots at 200 rpm for about 20 hours. The resulting coating dispersion (ALYMERS® HC-7002/Crosslink r CX-100/EMPEROR® E1200/NACURE® XP-357/BYK® 333=75/25/6.5/0.2/0.05 in methylene chloride, about 20 weight percent solids) was filtered through a 20-micron Nylon cloth filter to obtain the final overcoat coating dispersion.

The dispersion was coated on a 3 mil PET film via either a lab draw bar coater or a production extrusion coater and subsequently cured at 140° C. for about 5 minutes to obtain a film of about 15 micron thickness.

The resistance of the cross-linked overcoat was measured at about $5.8.10^8$ ohm using a Trek Model 152-1 Resistance Meter. The resistance was very uniform across the entire 2.5 inch×17 inch (the dimension of the real blade petal assembly) sample strip. An internal rub/wear test to simulate the real wear situation in the machine has shown that after 1 million rub/wear cycles, the disclosed aziridine/carboxylated polyester crosslinked outer layer showed almost no wear spots, whereas the current mainline back layer, a thermoplastic polyester film showed significant wear. When the curing time was further reduced to 3 minutes, the improvement of the rub/wear resistance was not as significant as that cured for 5 minutes. Thus, it has been determined that a 5 minute curing time provides significantly enhanced rub resistance.

In conclusion, the disclosed aziridine/carboxylated polyester cross-linked film on PET meets the key requirements for a back layer on a TAB.

It will be appreciated that variants of the above-disclosed and other features and functions or alternatives thereof, may be combined into other different systems or applications. Various presently unforeseen or unanticipated alternatives, modifications, variations, or improvements therein may be subsequently made by those skilled in the art which are also encompassed by the following claims.

What is claimed is:

1. An apparatus for transferring a developed image from an image bearing surface to a copy sheet, the apparatus comprising:

a charging station for charging the copy sheet to attract the developed image from the image bearing surface to the copy sheet, wherein said charging station includes a corona generating device spaced from the image bearing surface to define a gap therebetween through which the copy sheet passes;

a transfer assist blade for pressing the copy sheet into contact with the developed image on the image bearing surface in a region proximate to the charging station, wherein the transfer assist blade is shifted between a non-operative position spaced from the image bearing surface, and an operative position in contact with the copy sheet on the image bearing surface, wherein the transfer assist blade comprises in sequence:

a wear layer for contacting the copy sheet;

an interior layer; and a back layer comprising a polyethylene terephthalate film having an outer layer comprising cross-linked aziridine/carboxylated polyester and a conductive component, wherein an outer surface of the back layer has a surface resistance of from about $1\times10^8$ ohms to about $9.99\times10^8$ ohms; and a lever member for shifting the transfer assist blade between the non-operative position and the operative positions responsive to a registration signal.

2. The apparatus of claim 1, wherein the polyethylene terephthalate film has a thickness of from about 50 microns to about 200 microns.

3. The apparatus of claim 1, wherein the conductive component is selected from the group consisting of carbon black carbon nanotube, graphene, graphite, metal oxides, polyaniline, polypyrrole and polythiophene.

4. The apparatus of claim 1, wherein the back layer further comprises a leveling agent.

5. The apparatus of claim 4, wherein leveling agent is selected the group consisting of:

a polyester modified polydimethylsiloxane, a polyether modified polydimethylsiloxane, a polyacrylate modified polydimethylsiloxane, a polyester polyether modified polydimethylsiloxane, and mixtures thereof.

6. The apparatus of claim 1, wherein the back layer further comprises an acid catalyst selected from the group consisting of: aliphatic carboxylic acids, such as acetic acid, chloroacetic acid, trichloroacetic acid, trifluoroacetic acid, oxalic acid, maleic acid, malonic acid, lactic acid, citric acid; aromatic carboxylic acids, aliphatic sulfonic acids, aromatic sulfonic acids and phosphoric acid.

7. The apparatus of claim 1, wherein the outer layer has a thickness of from about 0.5 microns to about 50 microns.

8. The apparatus of claim 1, wherein the wear layer of the transfer assist blade has a surface resistance of greater than about $10^{10}$ ohms.

9. The apparatus of claim 1, wherein the wear layer of the transfer assist blade has a thickness from about 100 microns to about 200 microns.

10. The apparatus of claim 1, wherein said charging station includes a corona generating device spaced from the image bearing surface to define a gap therebetween through which the copy sheet passes.

11. The apparatus of claim 1, wherein the wear layer of the transfer assist blade comprises an ultra high molecular weight polymer.

12. A transfer assist blade for an electrostatographic machine, the electrostatographic machine comprising a charging station for charging a copy sheet to attract a developed image from an image bearing surface to a copy sheet, wherein said charging station includes a corona generating device spaced from the image bearing surface to define a gap therebetween through which the copy sheet passes, the transfer assist blade comprising:

a wear layer for contacting a copy sheet, wherein the wear layer of the transfer assist blade has a surface resistance of greater than about $10^{10}$ ohms;

an interior layer having a thickness of from about 150 microns to about 500 microns; and a back layer comprising a polyethylene terephthalate film having an outer layer comprising cross-linked aziridine/carboxylated polyester at a weight ratio of from about 0.5/99.5 to about 40/60 and a conductive component wherein an outer surface of the back layer has a surface resistance of from about $1\times10^8$ ohms to about $9.99\times10^8$ ohms.

13. The transfer assist blade of claim 12 comprising a thickness between about 400 microns and about 900 microns.

14. The transfer assist blade of claim 12, wherein the transfer assist blade has a deflection of about 3 mm under a 3 gram load.

15. An electrostatographic printing machine of the type in which a developed image is transferred from a photoconductive surface to a copy sheet at a transfer station, comprising:

an electrostatic charging unit for charging the copy sheet to attract the developed image from the photoconductive surface toward the copy sheet wherein said electrostatic charging unit includes a corona generating device spaced from the photoconductive surface to define a gap therebetween through which the copy sheet passes;

a transfer assist blade for pressing the copy sheet into contact with at least the developed image on the photoconductive surface wherein the transfer assist blade includes;

a wear layer for contacting the copy sheet, wherein the wear layer of the transfer assist blade has a surface resistance of greater than about $10^{10}$ ohms, an interior layer having a thickness of from about 150 microns to about 500 microns; and a back layer comprising a polyethylene terephthalate film having an outer layer comprising cross-linked aziridine/carboxylated polyester at a weight ratio of from about 0.5/99.5 to about 40/60, a conductive component, a leveling agent and an acid catalyst wherein an outer surface of the back layer has a surface resistance of from about $1\times10^{8}$ ohms to about $9.99\times10^{8}$ ohms, the transfer assist blade adapted to be shifted between a non-operative position spaced from the photoconductive surface, and an operative position in contact with the copy sheet on the photoconductive surface; and a lever member for shifting the transfer assist blade between the non-operative position and the operative positions, the lever member responsive to a registration signal.

16. The electrostatographic printing machine of claim 15, wherein the wear layer of the transfer assist blade has a surface resistance of greater than about $10^{10}$ ohms.

17. The electrostatographic printing machine of claim 15, wherein leveling agent is selected the group consisting of a polyester modified polydimethylsiloxane, a polyether modified polydimethylsiloxane, a polyacrylate modified polydimethylsiloxane, a polyester polyether modified polydimethylsiloxane, and mixtures thereof.

18. The electrostatographic printing machine of claim 15, wherein the back layer further comprises an acid catalyst selected from the group consisting of aliphatic carboxylic acids, such as acetic acid, chloroacetic acid, trichloroacetic acid, trifluoroacetic acid, oxalic acid, maleic acid, malonic acid, lactic acid, citric acid; aromatic carboxylic acids, aliphatic sulfonic acids, aromatic sulfonic acids and phosphoric acid.

19. The electrostatographic printing machine of claim 15, wherein the transfer assist blade has a deflection of about 3 mm under a 3 gram load.

20. The electrostatographic printing machine of claim 15, wherein the wear layer of the transfer assist blade comprises an ultra high molecular weight polymer.

* * * * *